US008701314B2

(12) United States Patent
Redding

(10) Patent No.: US 8,701,314 B2
(45) Date of Patent: Apr. 22, 2014

(54) FLUID JETS

(76) Inventor: John Redding, Attleborough (GB)

( * ) Notice: Subject to any disclaimer, the term of this patent is extended or adjusted under 35 U.S.C. 154(b) by 627 days.

(21) Appl. No.: 13/132,740

(22) PCT Filed: Dec. 16, 2008

(86) PCT No.: PCT/GB2008/051191
§ 371 (c)(1),
(2), (4) Date: Jun. 3, 2011

(87) PCT Pub. No.: WO2009/077786
PCT Pub. Date: Jun. 25, 2009

(65) Prior Publication Data

US 2011/0283569 A1 Nov. 24, 2011

(30) Foreign Application Priority Data

Dec. 18, 2007 (GB) ..... 0724592.1

(51) Int. Cl.
*E02F 5/00* (2006.01)
*E02F 5/28* (2006.01)

(52) U.S. Cl.
USPC ..... 37/344; 37/307

(58) Field of Classification Search
USPC ..... 37/317–326, 330, 341, 344, 307; 415/124.2, 131, 206, 208.3; 416/188, 416/243; 417/183, 197
See application file for complete search history.

(56) References Cited

U.S. PATENT DOCUMENTS

| | | | | | |
|---|---|---|---|---|---|
| 3,010,402 | A | * | 11/1961 | King | 415/131 |
| 3,148,464 | A | | 9/1964 | Jones | |
| 3,774,323 | A | * | 11/1973 | Vaughn | 37/317 |
| 4,327,506 | A | * | 5/1982 | Bos | 37/325 |
| 5,487,644 | A | * | 1/1996 | Ishigaki et al. | 415/220 |
| 6,125,560 | A | | 10/2000 | Beaumont | |

FOREIGN PATENT DOCUMENTS

| | | |
|---|---|---|
| GB | 2 359 103 A | 8/2001 |
| WO | WO 94/20362 | 9/1994 |
| WO | WO 2004/045775 | 6/2004 |
| WO | WO 2004/065700 | 8/2004 |
| WO | WO 2005/002735 | 1/2005 |

OTHER PUBLICATIONS

International Search Report of International Application No. PCT/GB2008/051191, dated Dec. 16, 2007 (English Text).

* cited by examiner

*Primary Examiner* — Robert Pezzuto
(74) *Attorney, Agent, or Firm* — Fay Sharpe LLP

(57) ABSTRACT

A fluid jet apparatus includes a body having a fluid flow path defined between a fluid inlet and a fluid outlet. A thrust device is mounted within the fluid flow path to direct in use a flow of fluid along the fluid flow path. At least a portion of the fluid flow path includes a duct. The thrust device includes a propeller mounted within the duct. The apparatus further includes a plate spaced from the fluid inlet defining a space therebetween. A plurality of elongate pivotable vanes is positioned in a generally circular orientation in the space and about the axis of the flow path and with their pivoting axes aligned with the axis of the flow path. The thrust device is adapted to rotate in a direction opposite the direction of flow of fluid through the vanes into the space.

8 Claims, 4 Drawing Sheets

FLUID JETS

The present invention relates to improvements in or relating to fluid jets and their effects and apparatus that can be developed to take advantage of specific forms of jets and methods of performing functions using such jets.

It is well known that when sea-going vessels operate in shallow water, the wash from the propeller can cause erosion of the bed. Propeller scour, as it is called, is the result of shear stresses, and to a lesser extent hydro-dynamic pressures, applied to the bed by the flow of water set in motion by the propeller. These forces cause surface particles to be dislodged, which then become carried along with the flow; the rate of erosion increasing as a higher power of the overlying flow velocity in excess of a certain threshold that depends on the bed material. Whilst propeller scour can be detrimental in ports, harbours and navigation channels, leading to undermining of structures and embankments, as well as unwanted siltation elsewhere, it can equally be beneficial if the process can be harnessed and applied in a controlled fashion.

U.S. Pat. No. 6,125,560 discloses a means for controlled application of the wash from a ducted propeller, for the purposes of seabed excavation and dispersal of the excavated material. No specific mention is made, however, about the nature of the flow or the excavation process; although it is envisaged that the main agency for dispersal of the material will be tidal currents. WO2004/065700 notes that since the propeller is located close to the duct outlet, the wash possesses certain flow features that are peculiar to propeller-generated flows. These include the fact that the flow is swirling (i.e. it has a component of rotation about the flow axis) and it is imbued with a number of concentrated vortical structures: including an axial hub vortex and a helical pattern of peripheral tip vortices.

The presence of swirl, together with the associated vortical structures, can enhance the excavation of seabed sediments by ducted propellers due, in part, to the unsteady nature of the flow. It can also enable the ducted propeller flow to be manipulated to enhance particular flow characteristics. WO2005/002735 describes a means for flow manipulation, which involves expansion of the flow by a diffusing, or flared, nozzle attached coaxially to the exit of the propeller duct.

It has been noticed, however, that if the flow from a ducted propeller is forced to converge, in a particular way, excavation will takes place: i) over a much larger area, ii) at a greatly increased rate, and iii) the excavated material will self-transport over long-distances before finally re-depositing. Each of these three attributes will be described in more detail below. The present invention is based upon the recognition that when all three attributes are operating in unison the ducted propeller has greatly increased utility for such applications as dredging, seabed levelling and underwater sediment management.

In order to appreciate the functional significance of the particular modification to a ducted propeller that produces the aforementioned desired attributes and which forms the subject matter of the present invention, it is necessary to have a basic understanding of propeller flows, particularly those from ducted propellers operating under high load. By high load is meant a ducted propeller operating in an essentially static mode and at maximum design propeller revs. In marine propulsion parlance this is often referred to as the bollard-pull (or maximum static thrust) condition. Close similarities thus exist between the ducted propeller of the present invention and such marine propulsion devices as: tunnel-thrusters of the type used on ferries and large vessels for slow-speed transverse manoeuvring. Similarly, an alternative usage for the present ducted propeller is as an axial flow propeller pump: for pumping large quantities of water at relatively low pressures.

The present invention provides an apparatus comprising a body having a fluid flow path defined between a fluid inlet and a fluid outlet and thrust means mounted within the fluid flow path to direct, in use, a flow of fluid, along the fluid flow path; wherein at least a portion of the fluid flow path comprises a duct and wherein the thrust means comprises a propeller mounted within the duct; characterised in that the apparatus further comprises a plate spaced from the fluid inlet defining a space therebetween; wherein a plurality of elongate pivotable vanes are positioned in a circular orientation in the space, about the axis of the flow path and with their pivoting axes aligned with the axis of the flow path; wherein the thrust means is adapted to rotate in a direction opposite to the direction of flow of fluid through the vanes into the space.

Preferably, the vanes are arranged in a circle so that their pivotal points are coincident with the lip of the fluid inlet and they have a height equal to the space between the fluid inlet and the plate; wherein the height to diameter ratio of the vanes is between 0.4 and 0.6, more preferably about 0.5.

Preferably, the vanes are collectively angled at an angle of between 45° and 75° to the radius of the circle that defines each pivot point, preferably about 60°.

The above and other aspects of the present invention will now be described in further detail, by way of example only, with reference to the accompanying drawings, in which.

Figure 1:
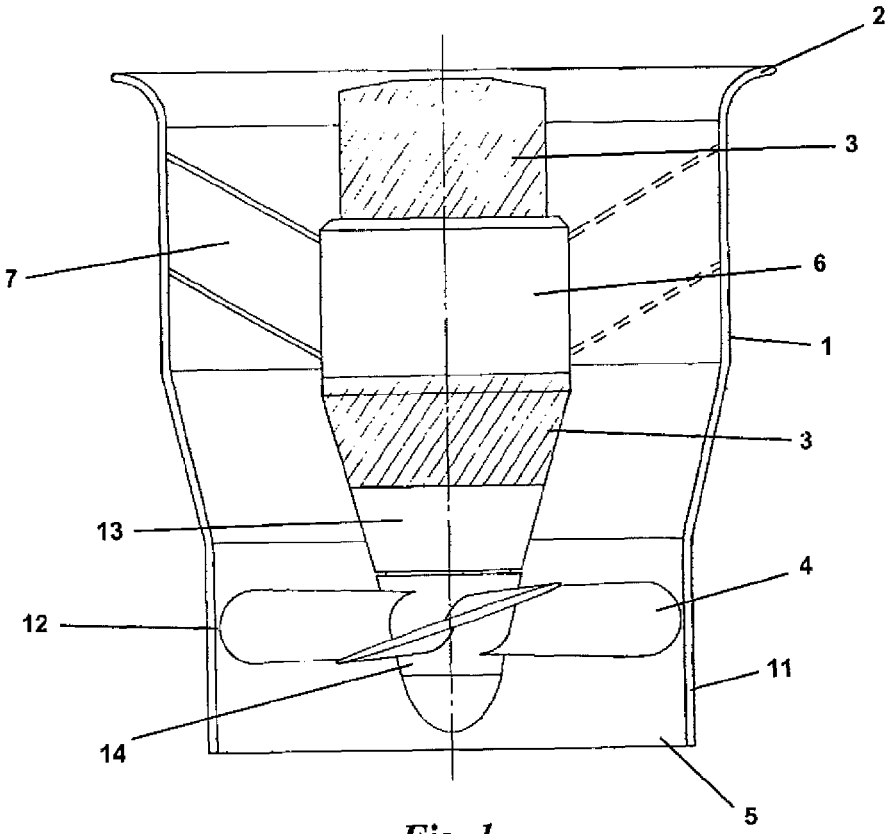
FIG. 1 is a sectional side view through a prior art ducted propeller.
Figure 2:
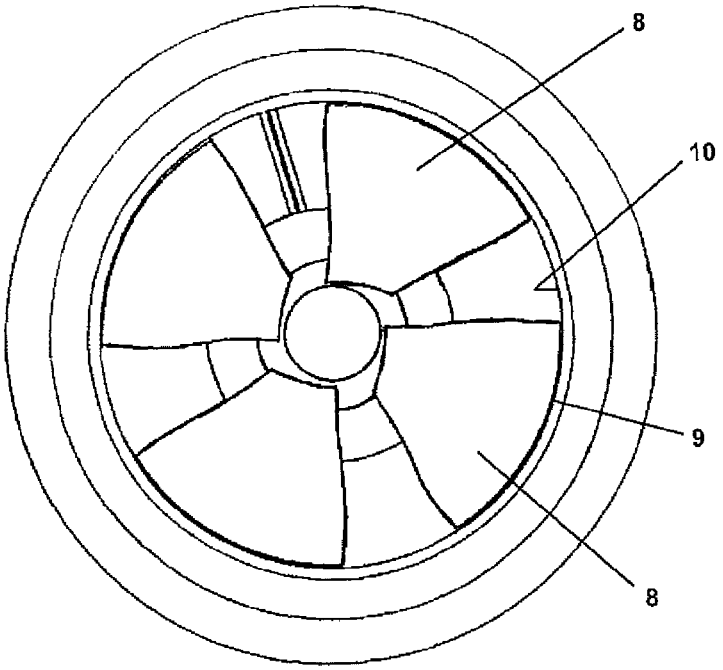
FIG. 2 is a bottom view of the apparatus of FIG. 1.

The general form of the ducted propeller utilised in the present invention is shown in sectional view in FIG. 1 and is generally similar to that disclosed in WO2004/065700. This features a cylindrical duct (1) of varying diameter, with a bellmouth inlet (2), a central coaxial motor (3, shown hatched), which in this case is hydraulic, but could also be electric or pneumatic and a propeller (4) attached directly to the motor shaft and located close to the outlet end (5) of the duct. The motor is attached to the duct by a collar (6) and angled struts (7), which are of unequal number to the propeller blades. The duct and motor are shaped such that they create an annulus of more or less constant cross-sectional area between the inlet and outlet ends of the duct. Propeller (4), shown face-on in FIG. 2, is of the Kaplan type, a design that features large symmetrical blades (8), typically four in number as shown here, whose blade tips (9) conform to the inner circumference (10) of the straight outlet section (11) of the duct. The propeller rotates within the duct with a minimal gap clearance (12) between the blade tips and the inner wall of the duct. The downstream end of the motor (3) is formed into a tapered (rope-guard) extension (13), so that the taper angle is continuous with that of the propeller hub (14).

It should be noted that: i) the annular flow through the duct is forced to converge before it passes through the plane of the propeller by the combined shape of the duct and the motor housing, ii) the hub of the propeller has a diameter, which is approximately 0.3 times the diameter of the propeller and iii) the propeller has a slightly unusual pitch distribution (the blades are over-pitched in the hub region and under-pitched towards the tips). The latter is a subtle propeller design feature, intended to enhance static thrust that is not evident from either FIG. 1 or FIG. 2.

For the purposes of seabed excavation or other applications involving impingement of the propeller duct flow against a surface, the duct arrangement shown in FIG. 1 would normally be maintained at a specified distance from, and angle to, the surface to be jetted. WO2004/045775 discloses a variety of deployment means that can similarly be used with this invention.

Figure 3:
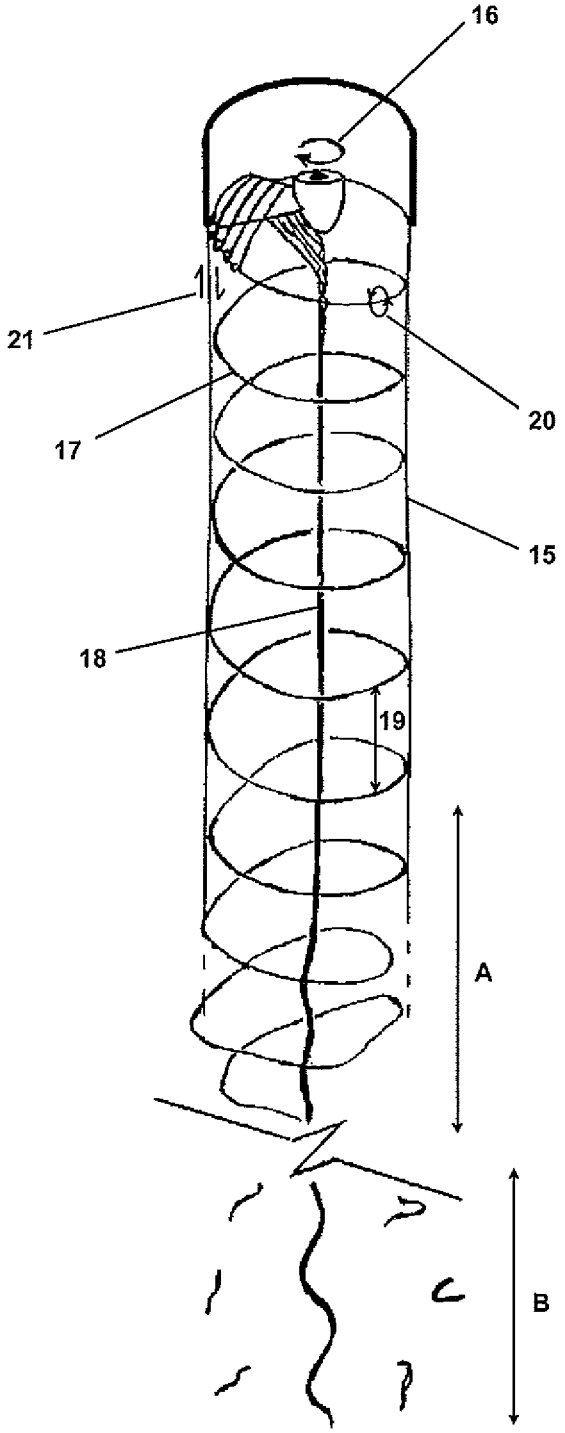
FIG. 3 illustrates schematically the principal characteristics of the fluid flow of the apparatus of FIG. 1.

FIG. 3 shows, in diagrammatic form, the main features of a normal ducted propeller outlet flow, which are considered important for an understanding of the present invention. This is the outlet flow that would be produced in the absence of the aforementioned system of inlet vanes or with the inlet vanes orientated radially so as to enforce radial inlet flow. The flow (or jet) emerging from the duct has a diameter equivalent to that of the duct and this diameter is maintained for some distance downstream. The outer envelope of the flow is called the streamtube (15) and it separates high velocity duct flow from the still ambient fluid. Inside the streamtube the flow has axial as well as tangential (swirl) velocity components. The swirl velocity is due to the rotation of the propeller, as indicated by the curved arrow (16), and the direction of swirl rotation is the same as that of the propeller. Under heavily-loaded operating conditions the swirl flow has an approximately uniform velocity of fluid rotation.

The streamtube represents a free shear surface, across which there is a jump in axial as well as swirl velocity. Vorticity is associated with shearing between two fluid bodies and in the present context it can be thought of as the fluid-equivalent of roller bearings—allowing the duct flow to move relative to the still ambient without significant friction or exchange of momentum.

In order to appreciate the significance of voracity, and to better understand the features of this invention, the reader is invited to perform a simple demonstration. Take a pencil, and place it on the base of the palm of the left hand. Hold it in place with the finger tips of the right hand, and then move the right hand forward (while keeping the left hand still) so that the base of the palm of the right hand comes to coincide with the finger tips of the left hand. In carrying out this action it will be noticed that: i) the pencil rotates with a sense of rotation that is anti-clockwise for a forward movement of the right hand, and ii) the pencil moves a distance of one hand length, while the relative distance of movement of the hands is two hand lengths. This demonstration serves to highlight that whatever the relative speed of movement of the hands (provided that one hand is kept still), the pencil will always move at half this speed. Thus within a free shear layer, vorticity (the pencil) will always be transported at approximately half the relative speed of the adjacent fluid bodies (provided that one is static) and the sense of rotation of the vorticity will be determined by the relative direction of shear (relative movement of the hands). Note that if both hands (fluid bodies) move in opposite directions, the pencil (vorticity) may remain static and only rotate.

Since the flow from a ducted propeller possess both axial and swirl momentum the vorticity residing within the streamtube will be helical in character. Helical vorticity (or helicity) can be thought of as a combination of axial vorticity (which is associated with tangential or swirl fluid movement) and azimuthal or ring vorticity (which is associated with axial fluid movement). The familiar smoke ring vortex is an example of pure azimuthal vorticity, being always associated with axial flow. If the axial flow that sustains the smoke ring were also to rotate, the smoke ring would take the form of a helix.

The propeller blades, being moving boundary surfaces, are where most of the vorticity originates, as indicated diagrammatically in FIG. 3. The upper (suction) surface of the blades, contribute vorticity mainly to the tip vortices (17), while the lower (pressure) surfaces contribute vorticity mainly to the centreline hub vortex (18). The inner surface of the duct, being static, behaves rather like the still ambient fluid. Helical tip vortices (17) trail from the downstream tips of the propeller blades, with their sense of winding being opposite to the direction of rotation of the propeller. The axial separation distance (19) between adjacent whorls of the same tip vortex structure is a measure of the helical pitch. Note that FIG. 3 shows only one propeller blade and one tip vortex, although there would be four corresponding to the number of propeller blades. The direction of fluid rotation within each tip vortex, as indicated by the small curving arrows (20) in FIG. 3, reflects the relative sense of axial shear across the streamtube surface, as indicated by the paired arrows (21). In actual fact, with a ducted propeller of the type shown in FIG. 1, the tip vortices would be subsumed within the boundary layer flow that develops on the duct wall and is shed from the trailing edge of the duct, so the streamtube (15) takes the form of a more evenly distributed sheet of vorticity. Nevertheless the sense of spiralling and rotation is the same as indicated in FIG. 3.

Vorticity has no capacity for self-transport—just as the pencil only moves by virtue of the hand moving. Vorticity is, therefore, transported (advected) by the flow and for this reason it is often described as being 'frozen' within a flow. However, in real fluids with strong vorticity, the vorticity can equally be considered as driving the flow, through the concept of vortex singularities acting as momentum sources. This is tantamount to saying that the pencil causes the hands to move!

In normal ducted propeller jets the outer stream tube vorticity can be considered as driving the whole of the axial flow as well as a component of the azimuthal (swirl) flow; specifically the outer part of the swirl flow. The hub vortex vorticity can be considered as driving the remainder of the azimuthal (swirl) flow and a counter component of the axial flow. What the latter means is that in normal ducted propeller jets the centreline part of the jet actually has near zero axial velocity. Near zero axial velocity equates to elevated stagnation pressure and it is this hydrodynamic pressure force which accounts for static thrust in ducted propellers used for slow-speed propulsion.

A feature of normal propeller-generated flows is that at a certain distance downstream the vortical structures start to exhibit increasing instability. This is shown in FIG. 3 (in the region marked by A) by spiralling of the hub vortex and increasing irregularity of the tip vortices. Eventually, in what is known as the far wake, (in the region marked by B in FIG. 3) the tip vortex structures break down and the hub vortex spiralling becomes very accentuated. This instability, which is associated with pressure fluctuations, typically occurs at a lesser distance downstream when the propeller is more heavily loaded.

Figure 4:
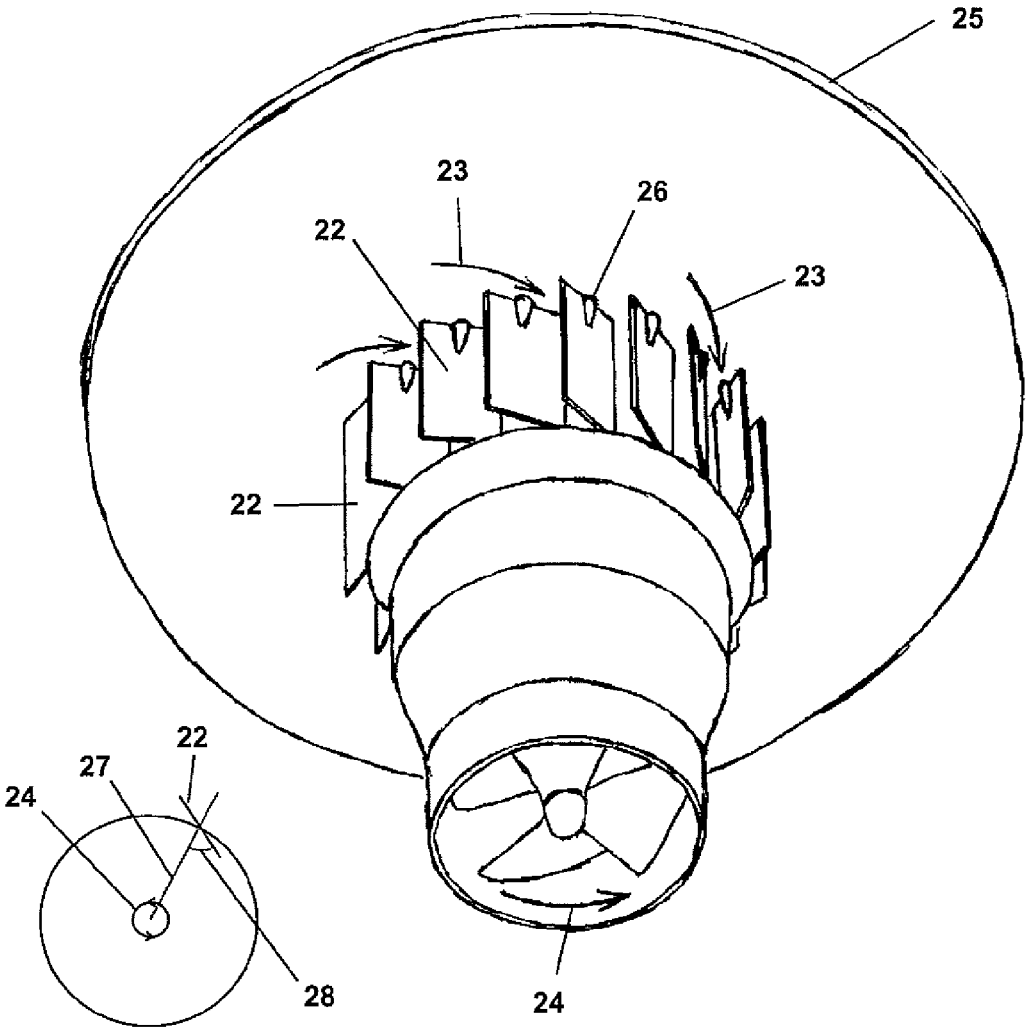
FIG. 4 is a perspective view from underneath of an embodiment of an apparatus in accordance with the present invention.

The present invention, which is shown diagrammatically in FIG. 4, is designed to alter the fluid working environment of the propeller. It does this by means of a series of vanes (22) that cause the inlet flow to enter the duct with a component of pre-swirl. The orientation of these vanes is such that the pre-swirl has a direction of fluid rotation, illustrated by arrows (23), which is opposite to the direction of rotation of the propeller, illustrated by arrow (24). The vanes are attached to plate (25) at pivot points (26), such that the setting angle can be adjusted, but the vanes can be locked into a fixed position when the device is being operated. Plate (25) might, for instance, be the top plate of a tank-enclosure such as the embodiment disclosed in WO2004/065700.

The vanes (22) shown in FIG. 4 are of relatively crude design and are made out of flat plate. Each vane turns the inlet flow slightly and so the simplicity of design is offset by having a large number of vanes (in this case 16 number). In alternative embodiments (not shown), the vanes are curved to provide a more hydrodynamic profile. The ratio of the height of the vanes to the diameter as circumscribed by their pivot points is important, since it determines (together with the angle of the vanes) the amount of swirl introduced into the inlet flow. The larger this ratio the smaller the inlet swirl and consequently the more the vanes have to be angled from the radial to achieve the optimum amount of swirl. With the set-up shown in FIG. 4 the height to diameter ratio is approximately 0.5 and the vanes have to be angled at about 60° to the radial to achieve the desired duct inlet flow.

The effect of the vanes and the resulting inlet pre-swirl is to change the vorticity produced by the propeller dramatically; essentially removing the hub vortex and the axial vorticity component of the tip vortices. The resulting jet has little or no swirl, while the axial flow has uniformly high velocity across the width of the jet. Static thrust is thus sacrificed for the sake of increase axial flow production. Importantly, the streamtube (tip vortex) vorticity is retained so that the jet remains columnar and does not interact with the ambient fluid.

The change in inlet flow characteristics associated with the inlet vanes results, in effect, in a reduction in the angle of attack of the incident flow relative to the propeller blades. As a result, the propeller is obliged to operate in a less heavily-loaded condition (the propeller absorbs less torque for the same rotation speed), and so produces significantly less static thrust. The consequent reduction in outlet swirl is the flow manifestation of this change in propeller operating characteristics. These effects are particularly evident when a single ducted propeller, with inlet flow vanes, is operated in a suspended mode with the jet pointing vertically downwards. Under these circumstances the equipment exhibits a higher apparent submerged weight (due to the reduced thrust) and a decreased tendency to rotate about the point of suspension (decreased torque reaction from the propeller).

With the correct setting angle of the inlet vanes, static thrust (due to hydrodynamic pressure) and torque reaction can be all but eliminated. This is the condition, which in practice has been found to produce the maximum rate of seabed excavation. An approximately 60° negative vane setting angle has been found to be the optimum. This angle (28) is measured relative to the plane of each vane and a radial line (27) passing through the duct centreline and the vane pivot point, as indicated in the inset diagram in FIG. 4. A negative angle refers to the fact that the vanes are set to impart a component of swirl to the inlet flow that is opposite to the direction of rotation of the propeller. It will be appreciated that there may be an element of adjustment (or tuning) of the inlet vane angle to achieve this optimum condition.

Figure 5:
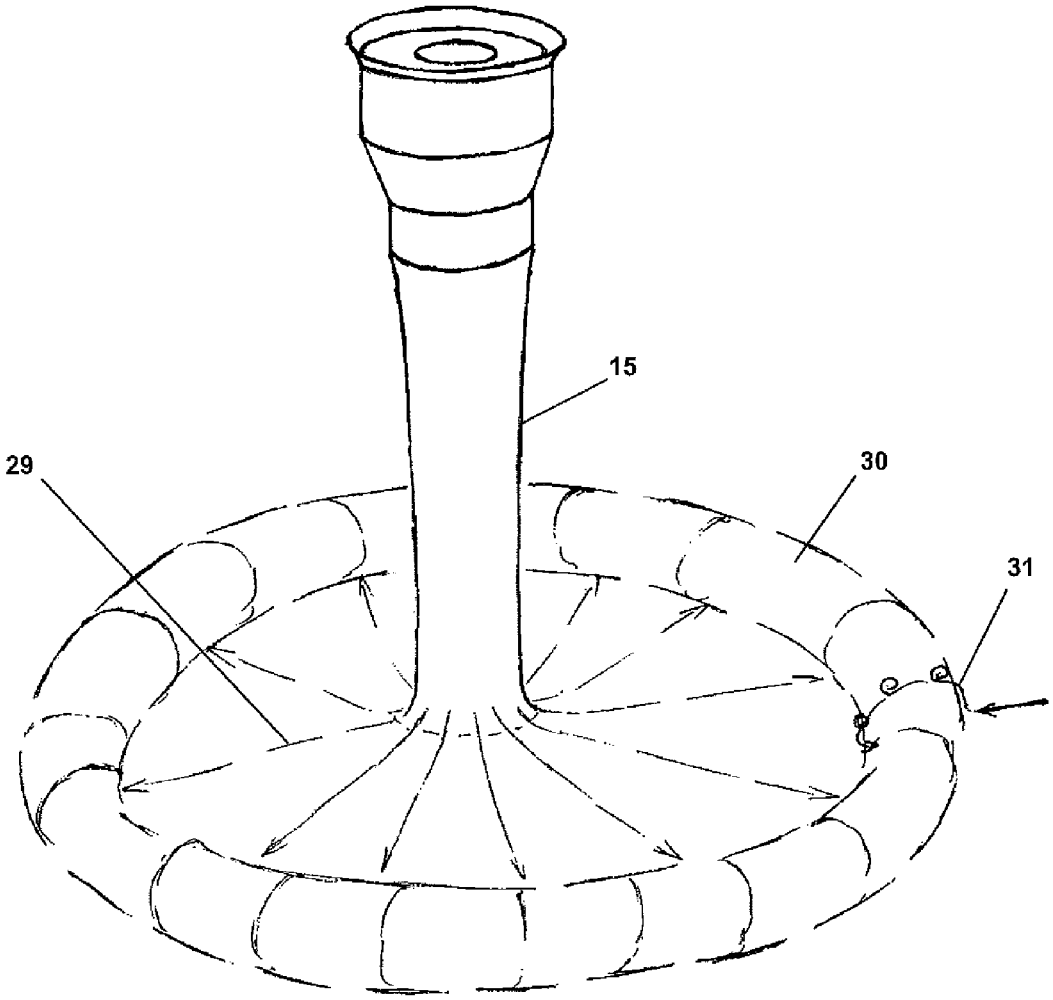
FIG. 5 is a schematic perspective and side view illustrating impact of the fluid flow from the apparatus in FIG. 4 upon a surface.

The general features of the exit flow (i.e. submerged jet) from the propeller duct of the present invention are shown diagrammatically in FIG. 5. Of key importance for the application of the device is the fact that the jet remains essentially columnar—it does not spread or otherwise intact with the ambient fluid, as typically occurs with normal submerged round jets. This means that the device can be operated at some distance (greater than 5 duct diameters) from the surface to be jetted, without significant loss of impinging jet momentum. The key to this capability is the retention of the outer streamtube envelope, which is a particular feature of propeller-generated flows.

In a number of respects, including its impingement behaviour against a surface, the submerged jet from this device resembles a free-fall liquid-into-air jet. To illustrate this behaviour the reader is invited to carry out the following simple experiment. Turn on a kitchen tap slightly so that a thin steady laminar stream of fluid is produced. It will be noticed that the fluid stream remains circular and continues to contract (but progressively less rapidly) from the tap to the point where it impinges against the base of the sink. These characteristics of a free-falling jet result from the fact that the jet is driven by gravity rather than by fluid pressure. It will be further noticed that where the jet strikes the sink base it turns sharply to form a thin wall flow that runs out radially across the surface. The thin fluid wall flow has a radial velocity approximately equal to that of the free-falling jet. That is to say, there is no loss of momentum or turbulence-generation where the jet strikes the surface. At a certain distance from the point of impingement, which is large compared to the diameter of the free-falling jet, the thin-film wall flow suddenly increases in depth and its velocity decreases appreciably. This is referred to as a circular hydraulic jump, and it represents a transition from super-critical (laminar) flow to sub-critical (turbulent) flow.

Impingement of the jet from this invention against a surface is illustrated in FIG. 5. Just like the free-falling jet, the jet from this device forms a high-velocity thin-film wall jet (29) that spreads radially outwards across the surface. Impingement is essentially a loss-free (non-turbulent) corner flow phenomenon. Note that in the impingement region, the streamtube envelope (15) of the free jet becomes the upper free shear surface of the wall jet. The azimuthal vorticity within this vortex sheet experiences a stretching due to radial spreading of the thin-film jet; this increases the strength of the vorticity and leads to an increase in velocity of the thin-film jet.

The combination of high-velocity jet impact, and high-velocity outward-deflected radial wall jet flow, is what makes this invention so effect for seabed excavation and other applications involving surface removal of material. Unlike the free-falling jet, however, which is constrained by gravity to flow downwards, the jet from the present device can be made to flow in any direction.

The present jet, like the free-falling jet, is able to extend out radially across the surface to many jet diameters before it becomes unstable. Instability in this case results in the vorticity finally rolling up to form a large roll vortex (30) as indicated in FIG. 5. The roll vortex represents the circulation which is conserved through the jet/impingement/wall-jet regions, indicating that the whole process is essentially a laminar (non-turbulent) one. Surface material removed as a result of scouring by the thin-film wall jet (29) ultimately ends up in the roll vortex, which entrains both wall jet flow and ambient fluid, and grows in size accordingly. Entrainment of ambient fluid takes place by a combination of engulfment, mainly on the inner side of the roll vortex and by mixing over the surface, which is associated with the formation of counter-signed vorticity. The process is indicated, diagrammatically on one streamline (31), in FIG. 5. Some of this counter-signed vorticity also originates from frictional boundary layer development at the base of the wall jet. Note that the roll vortex represents a 'graveyard flow structure' in the sense that it is where all the primary vorticity finally breaks down to turbulence as a result of mixing of jet and ambient fluid. Turbulent eddies produced in the roll vortex provide a very effective means for maintaining eroded sediment particles in suspension.

Note also that the lateral distance at which the roll vortex forms relative to the diameter of the impinging jet is dependent on the impinging velocity of the jet. It is not particularly sensitive to the distance of the jet nozzle above the jetting surface.

During seabed excavation operations, it is believed that the roll vortex goes through repeated cycles of growth and collapse, for the following reasons. During the latter part of the growth stage, the roll vortex is so highly charged with suspended material that it becomes gravitationally unstable. This is where gravity acting on the dense fluid overcomes circulation, resulting in collapse and the spontaneous formation of a dense fluid outflow across the surface. Such a flow is known as a density- or gravity-current, and it provides a very effective means for transporting sediment over long distances, even across flat or very gently inclined slopes. For seabed excavation it provides the means for long-distance self transport of the excavated material into deeper water. Collapse to form a density-current effectively destroys the roll vortex, which then starts to reform—hence the cyclic process, which also results in sequential waves of density-current flow being produced.

Thus by the simple addition of a set of vanes, of the correct size and orientation, a ducted propeller of fairly standard design can be converted into an extremely effective and efficient means for seabed excavation and controlled dispersal of the material. The fact that the excavated material invariably gravitates into deeper water, in the direction of seabed slope, is particularly important for navigation dredging and bed levelling operations, where the object is generally to lower the bed to some specified minimum level. It is also important from an environmental standpoint since density-current transport occurs very close to the bed with very little lofting of sediment to higher levels in the water column.

While underwater excavation is the intended primary application of this invention, alternative applications include: underwater cleaning, such as bio foul removal from ships' hulls, and in a land context, sweeping of leaves and dust. The latter being an alternative to conventional brush sweeping or the use of air blowers. Note that because leaves and dust are gathered into a roll vortex it is possible to exercise a much greater degree of control over their onward transport. By tilting the jet slightly it is also possible to displace the material in a preferred direction. For the latter application it is envisaged that the simple ducted propeller, with inlet vanes, might be attached to the rotating shaft enclosure of a garden strimmer, providing an alternative 'attachment tool' to the strimmer head.

The invention claimed is:

1. An apparatus comprising a body having a fluid flow path defined between a fluid inlet and a fluid outlet and thrust means mounted within the fluid flow path to direct, in use, a flow of fluid, along the fluid flow path; wherein at least a portion of the fluid flow path comprises a duct and wherein the thrust means comprises a propeller mounted within the duct; characterised in that the apparatus further comprises a plate spaced from the fluid inlet defining a space therebetween; wherein a plurality of elongate pivotable vanes are positioned in a generally circular orientation in the aforesaid space, about an axis of the flow path and with a pivot axis of each vane being aligned with the axis of the flow path; wherein the thrust means is adapted to rotate in a direction opposite to a direction of a flow of fluid through the plurality of vanes into the space.

2. An apparatus as claimed in claim 1 wherein the vanes have a height and are arranged about a circle having a diameter wherein the height to diameter ratio is between 0.4 and 0.6.

3. An apparatus as claimed in claim 2, wherein the ratio is about 0.5.

4. An apparatus as claimed in claim 1 wherein the vanes are each angled at an angle of between 15° and 45° to the circumference of a circle lying in a plane oriented perpendicular to the pivot axes of the plurality of vanes.

5. An apparatus as claimed in claim 4 wherein the angle is about 30°.

6. An excavating apparatus comprising an apparatus as claimed in claim 1.

7. An excavating apparatus as claimed in claim 6 further comprising support means for supporting the apparatus above a surface to be excavated.

8. An excavating apparatus as claimed in claim 7 wherein the support means is adapted for supporting the apparatus at a variable inclination to the surface.

* * * * *

UNITED STATES PATENT AND TRADEMARK OFFICE

CERTIFICATE OF CORRECTION

PATENT NO. : 8,701,314 B2
APPLICATION NO. : 13/132740
DATED : April 22, 2014
INVENTOR(S) : John Redding It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 956 days.

Signed and Sealed this
Twenty-ninth Day of September, 2015

Michelle K. Lee

Michelle K. Lee
*Director of the United States Patent and Trademark Office*